US007086185B2

(12) United States Patent
Pasqualini et al.

(10) Patent No.: US 7,086,185 B2
(45) Date of Patent: Aug. 8, 2006

(54) DEVICE FOR COUPLING WEAR PIECES TO THE RECEPTACLE TOOLS OF A PUBLIC WORKS MACHINE

(75) Inventors: Charles Pasqualini, Feurs (FR); Jean Marc Noailly, Feurs (FR)

(73) Assignee: AFE Metal, Feurs (FR)

( * ) Notice: Subject to any disclaimer, the term of this patent is extended or adjusted under 35 U.S.C. 154(b) by 0 days.

(21) Appl. No.: 11/054,098

(22) Filed: Feb. 9, 2005

(65) Prior Publication Data

US 2005/0144817 A1 Jul. 7, 2005

Related U.S. Application Data

(63) Continuation of application No. PCT/FR2003/002953, filed on Oct. 8, 2003.

(30) Foreign Application Priority Data

Oct. 17, 2002 (FR) ..... 02 13172

(51) Int. Cl.
*E02F 9/28* (2006.01)

(52) U.S. Cl. ..... 37/468; 37/456; 172/713; 172/719; 172/750; 172/751; 172/753; 172/772.5; 403/291; 403/355; 403/374.1; 403/379.2; 403/379.4; 403/379.5; 403/379.6

(58) Field of Classification Search ..... 37/446–459, 37/903, 468; 172/701.1, 701.2, 701.3, 713, 172/719, 749–753, 762, 772, 772.5; 403/291, 403/373, 374.1, 355, 378–379.6
See application file for complete search history.

(56) References Cited

U.S. PATENT DOCUMENTS

| | | | | |
|---|---|---|---|---|
| 5,469,648 | A | 11/1995 | Jones et al. | 37/457 |
| 5,561,925 | A | 10/1996 | Livesay | 37/455 |
| 6,030,143 | A | 2/2000 | Kreitzberg | 403/374.1 |
| 6,385,871 | B1 | 5/2002 | Quarfordt | 37/457 |

FOREIGN PATENT DOCUMENTS

| | | |
|---|---|---|
| EP | 1 156 164 A1 | 11/2001 |
| EP | 1 174 547 A1 | 1/2002 |
| FR | 2 815 059 A1 | 4/2002 |

*Primary Examiner*—Christopher J. Novosad
(74) *Attorney, Agent, or Firm*—Heslin Rothenberg Farley & Mesiti P.C.

(57) ABSTRACT

In a device for coupling a tooth onto an adaptor nose with a key, the tooth includes a skirt shrouding the adapter nose beyond the key passage zone and having a configuration connected to a return wall, comprising a bordering ridge. The wall is provided in the width of the skirt and corresponds to the passage and positioning of the key. Proximate the ends of the wall, and in the thickness of the skirt, are provided passage openings for the key devoid of abutting function in operation and ensuring a guiding and stopping function only when the key is inserted or removed. The key comprises two components transversely mobile relative to each other.

10 Claims, 9 Drawing Sheets

Figure 1:
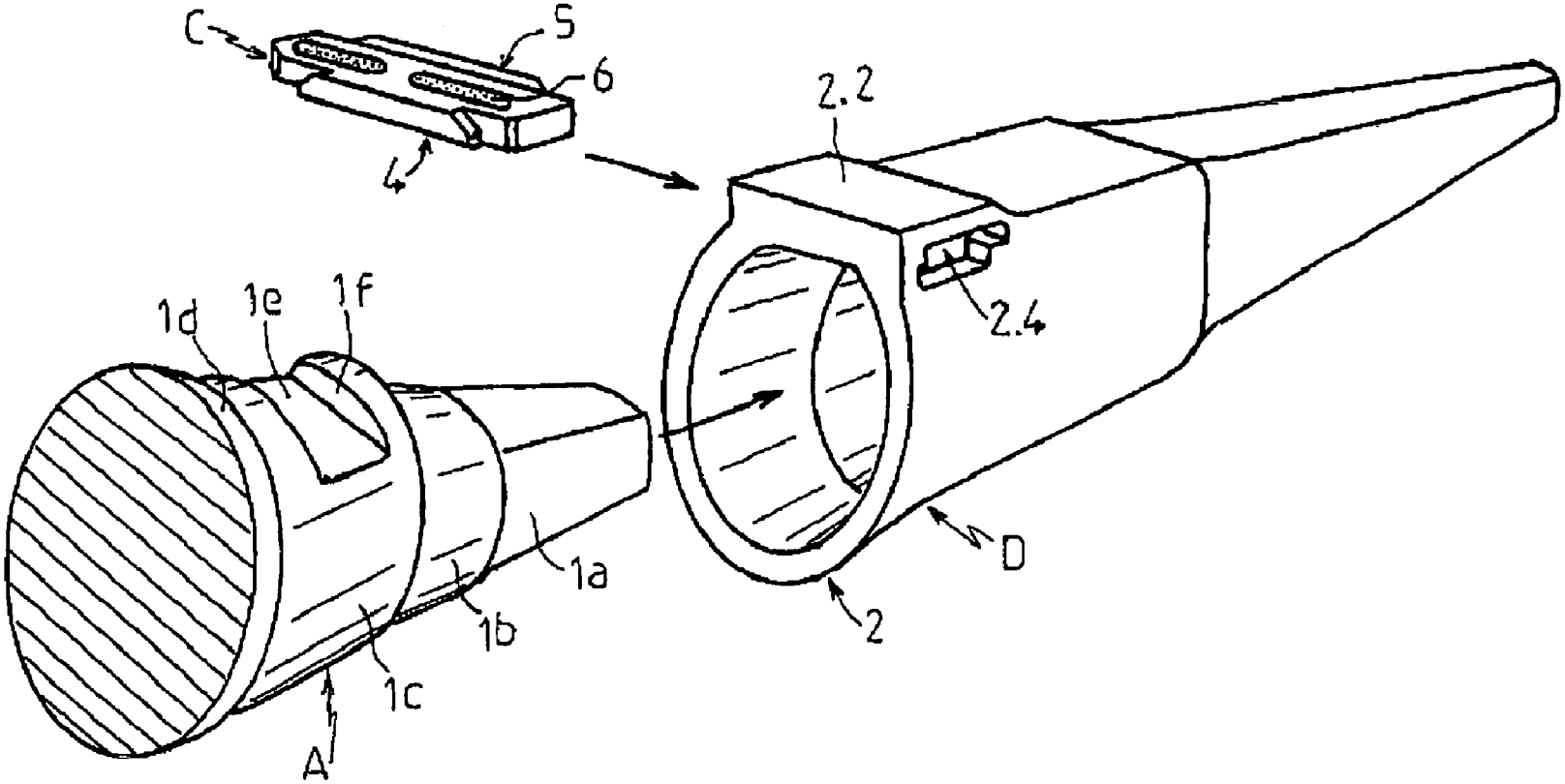

DEVICE FOR COUPLING WEAR PIECES TO THE RECEPTACLE TOOLS OF A PUBLIC WORKS MACHINE

CROSS-REFERENCES TO RELATED APPLICATIONS

This application is a continuation of International Application No. PCT/FR2003/002953, filed Oct. 8, 2003 and published in French as International Publication WO 2004/035945 A1 on Apr. 29, 2004, and claims priority from French Application No. 0213172 filed Oct. 17, 2002, the entire contents of these applications being incorporated herein by reference.

The invention relates to the technical sector of the equipment of public works machines having buckets, scoops or other receptacles able to scrape, pick up, and move materials or other items for the purpose of moving them away from a given location to other operating stations by means of land or maritime public works machines.

It is known practise in the prior art to have, on the aforementioned buckets, scoops, receptacles and similar, formed adapter noses that are capable of receiving removable teeth of matching shape. These teeth are in direct contact with the materials and substances to be picked up or scraped, and consequently are a source of rapid wear due to their pressure of use. The adapter noses formed on the buckets, scoops and other receptacles are male pieces rigidly attached to the lip of the bucket, the scoop or preformed receptacle and are made either separately or integrally when the scoop, bucket or receptacle or other particular tools are formed. The teeth that are fitted are female pieces produced so that their forms match the shapes of the adapter nose or noses so that they can be engaged thereon. The requirement to change the teeth when they wear out requires a linkage between the wear pieces and the corresponding adapter nose. In the prior art, the linkage offered by many manufacturers is a key which may be either metallic, or mixed, incorporating flexibility by means of a flexible material.

All the systems proposed in the prior art have a common point which is to present, adapt and provide a balance in the grip between the fitted tooth and the corresponding adapter nose. Specifically, with regard to use requirements, there needs to be a constant firm linkage between the tooth and the adapter nose that is adequate for the pushing and pulling stresses in the work done. Thus, the linkage between the two pieces is such that there must be a forward contact zone and opposing rearward contact zones in the linkage obtained between the tooth and the adapter nose. Various key shapes exist. Solutions have been proposed, for example that defined in patent EP 412 186.

There is a known concept of keys called sandwiches formed by metal elements gripping a rubber or elastomer packing that allows an adaptation of pressure of the components of the key. For example, patent FR 2204741 describes such a structure.

Also known are key systems that interfere with the adapter by external, vertical or horizontal, single or double, transverse contact.

The problem that is the origin of the invention is how to attach the replacement teeth to the existing adapter noses. The procedure was, based on varying shapes for off-the-shelf adapter noses, to conceive of a new method of assembly and coupling that would in particular allow a new tooth configuration to be positioned and attached to any type of adapter nose.

The problem was therefore to find a solution that would make it possible to dispense with the shapes and features of the teeth currently on the market and their system of linkage by dedicated keys while allowing the teeth to be positioned on the adapter nose.

A first objective sought, according to the invention, was therefore to use a new linkage concept in the adapter nose, indeed the key, that would be simple in design, easy to install, and that would satisfactorily stand up over time to the various external stresses inherent in this type of equipment and with a satisfactory hold.

Another objective sought, according to the invention, was to render extremely effective the positional stability of the key relative to the tooth and the adapter nose by increasing and optimizing the areas of contact.

Another objective sought, according to the invention, was, based on reconsidering the shape of the tooth, to improve the protection of the adapter nose, thus reducing the risks of damage by its contact with the outside environment.

These objectives and yet others will clearly emerge from the rest of the description.

According to a first feature, the device for coupling linkage between the wear pieces at the ends of receptacle tools in use on land or maritime public works machines comprises a tooth fitting onto an adapter nose and coupled by a key with a forward contact zone on the adapter and opposing rearward contact zones on the tooth, the adapter nose having a zone with a transverse vertical or horizontal cut-out for a key to pass through and defining a transverse border forming an abutment plane, the device being characterized in that the tooth has, at its rear end away from the scraping point, an enveloping skirt covering the adapter nose beyond the zone through which the key passes, said skirt having a shaped configuration connecting to a rectilinear flat return wall, comprising a bordering ridge, and in that said return wall is established in the width of the skirt and corresponding to the passage and the positioning of the key, and in that close to the ends of said return wall, and in the thickness of the skirt, are openings for the key to pass through with no abutment function in an operating situation and performing a guidance and abutment function exclusively when the key is inserted or removed, and in that the key comprises two components, movable one relative to the other, in a transverse direction, said key having, on each of these components, contact and opposing contact abutment zones of great length, on the one hand, against the opposite portion of the adapter nose and, on the other hand, against the return wall, at the place of its border forming a ridge, in the space situated between the openings for the key to pass through.

According to another feature, the device is characterized in that the key comprises two components that are adjustable relative to one another, in a transverse plane, and can be arranged with specific forms to perform the functions of contact and opposing contact relative to the tooth and to the adapter nose, and in that said components receive a packing material that links them and allows, after positioning of the key and by elastic relaxation, each of said components to butt up against the opposite faces of the adapter nose and of the tooth in the position of the return wall.

Figure 2:
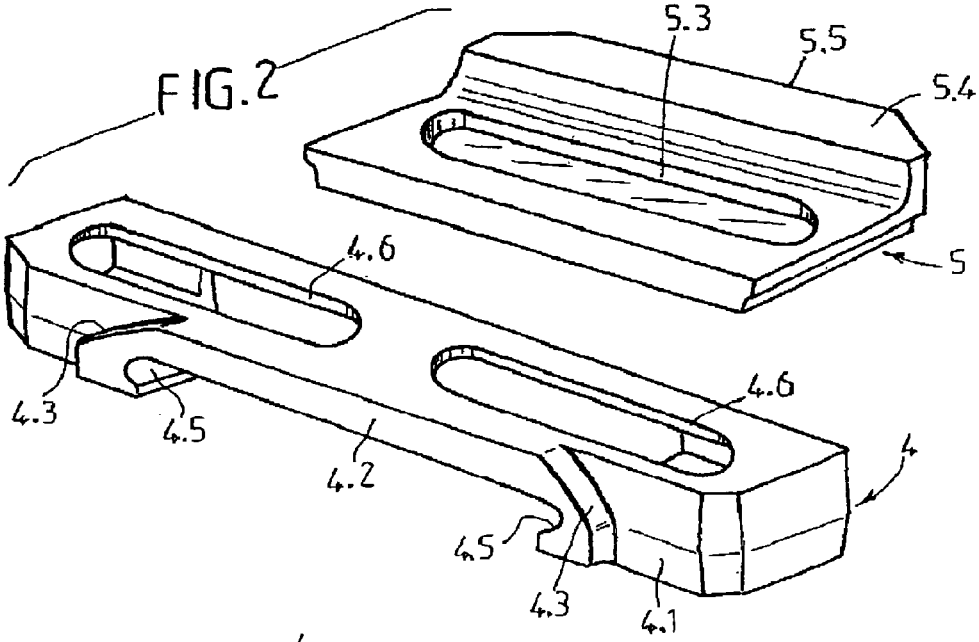
Figure 3:
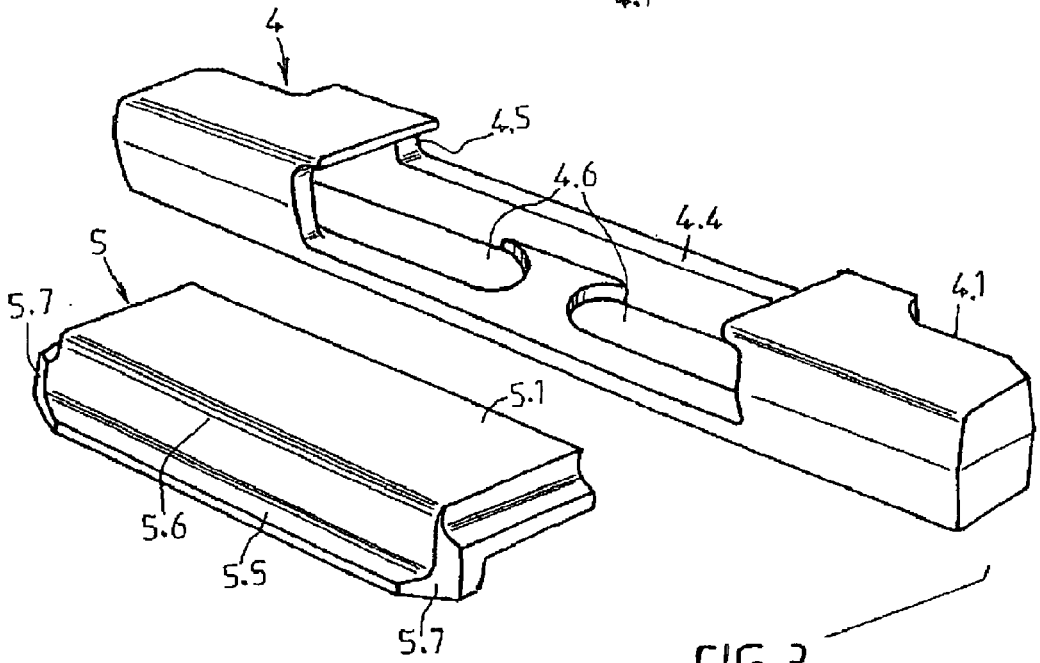
Figure 4:
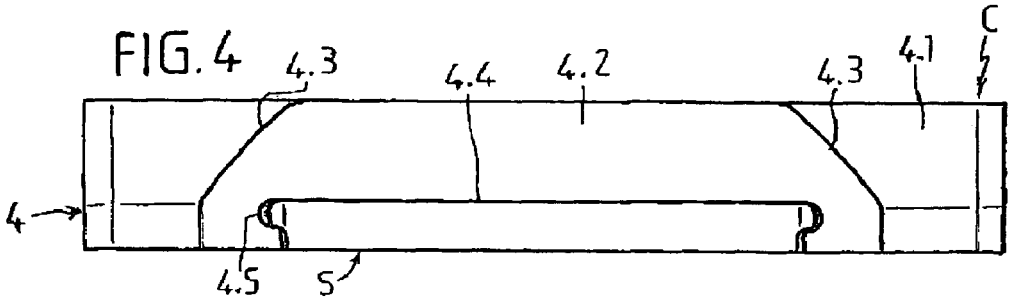
Figure 5:
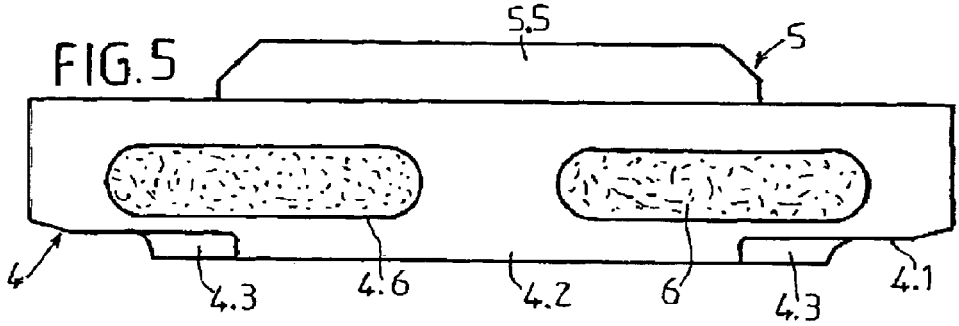
Figure 6:
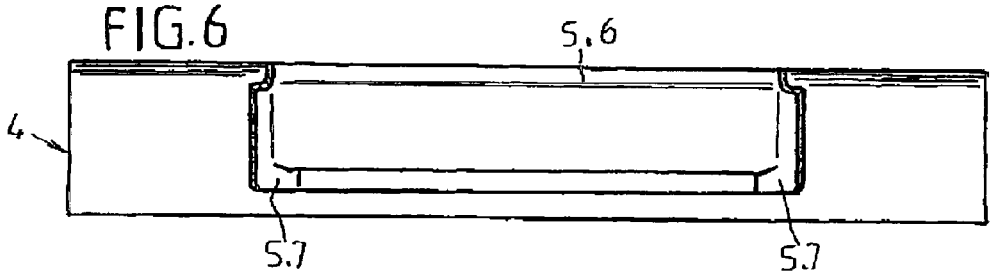
Figure 7:
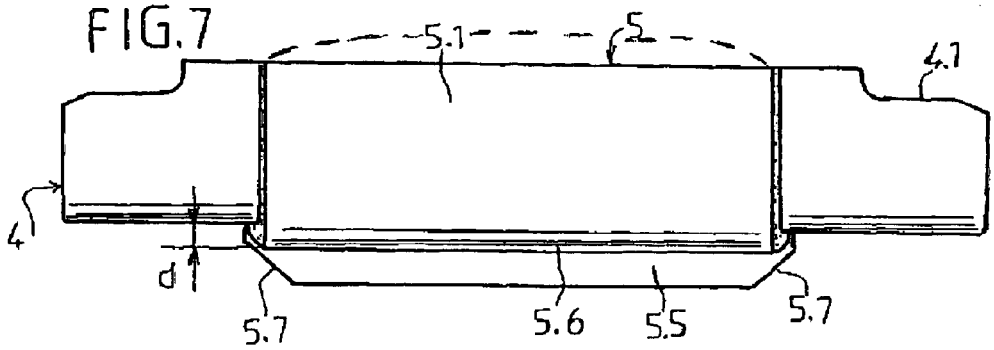
Figure 9:
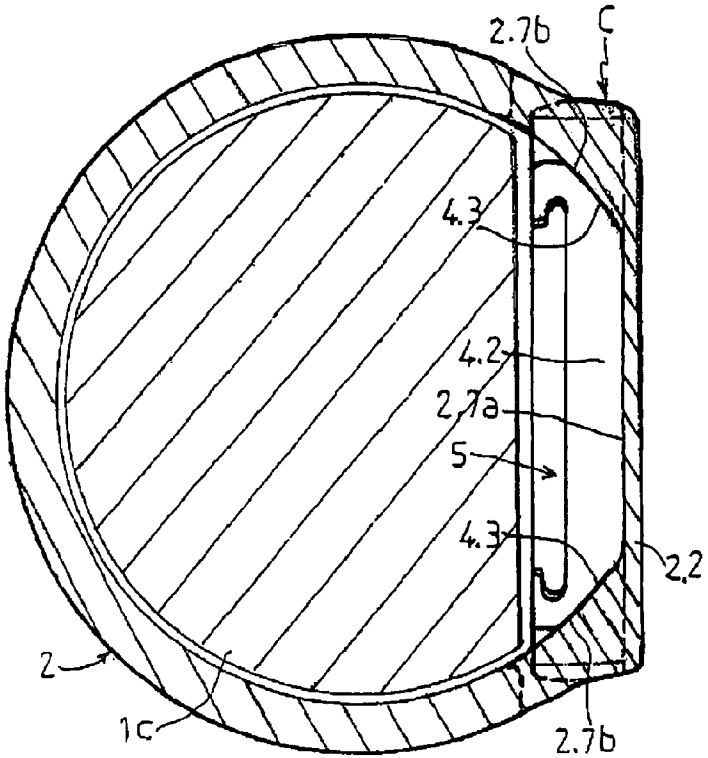
Figure 8:
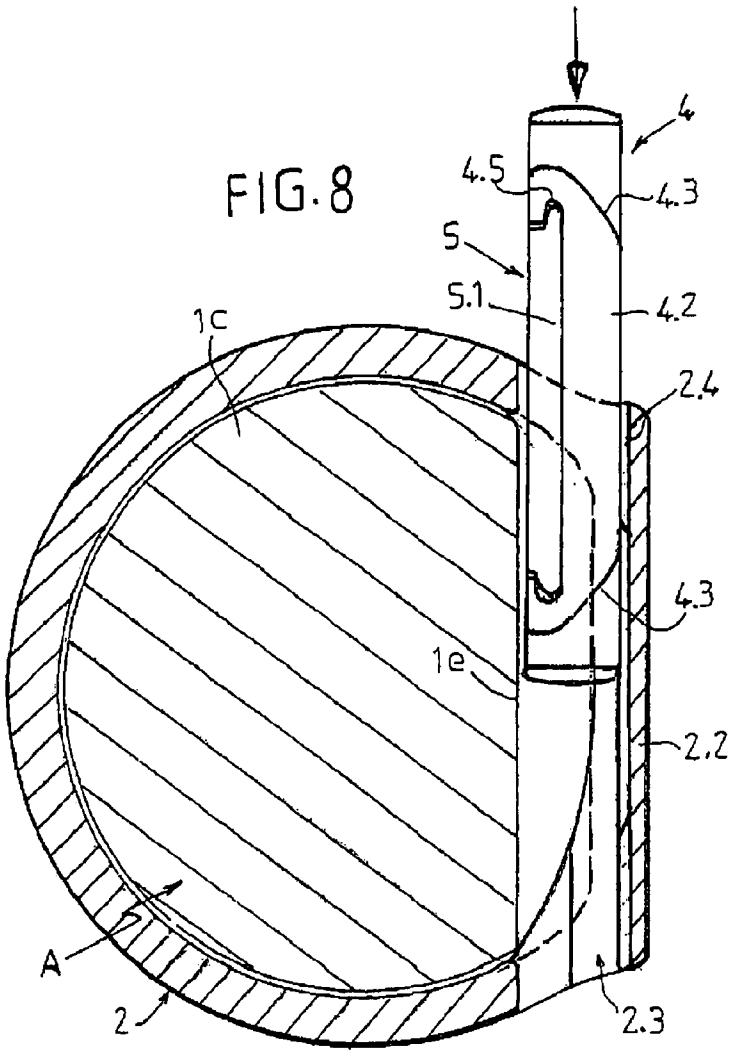
Figure 10A:
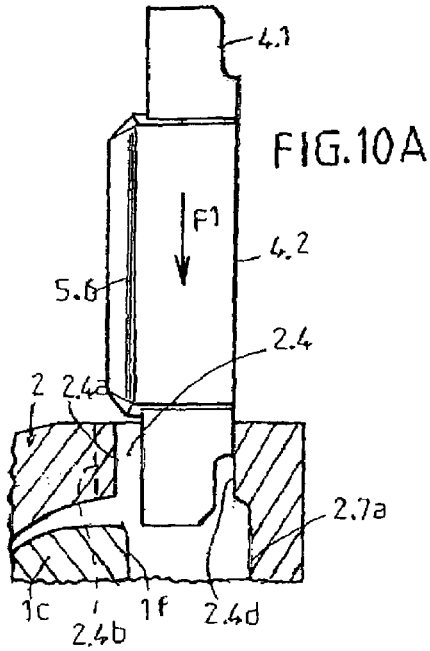
Figure 10B:
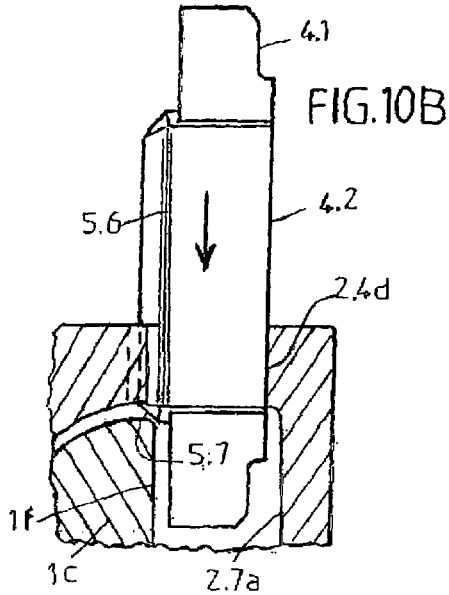
Figure 10C:
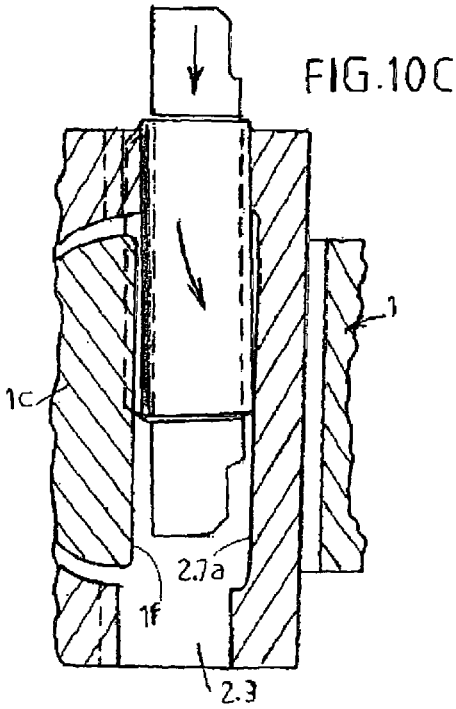
Figure 11:
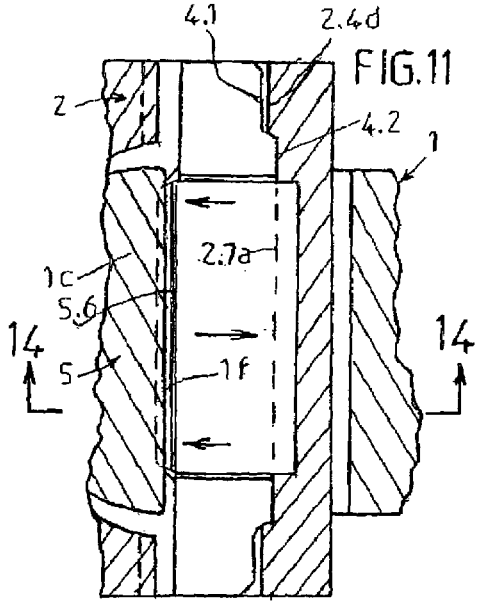
Figure 12:
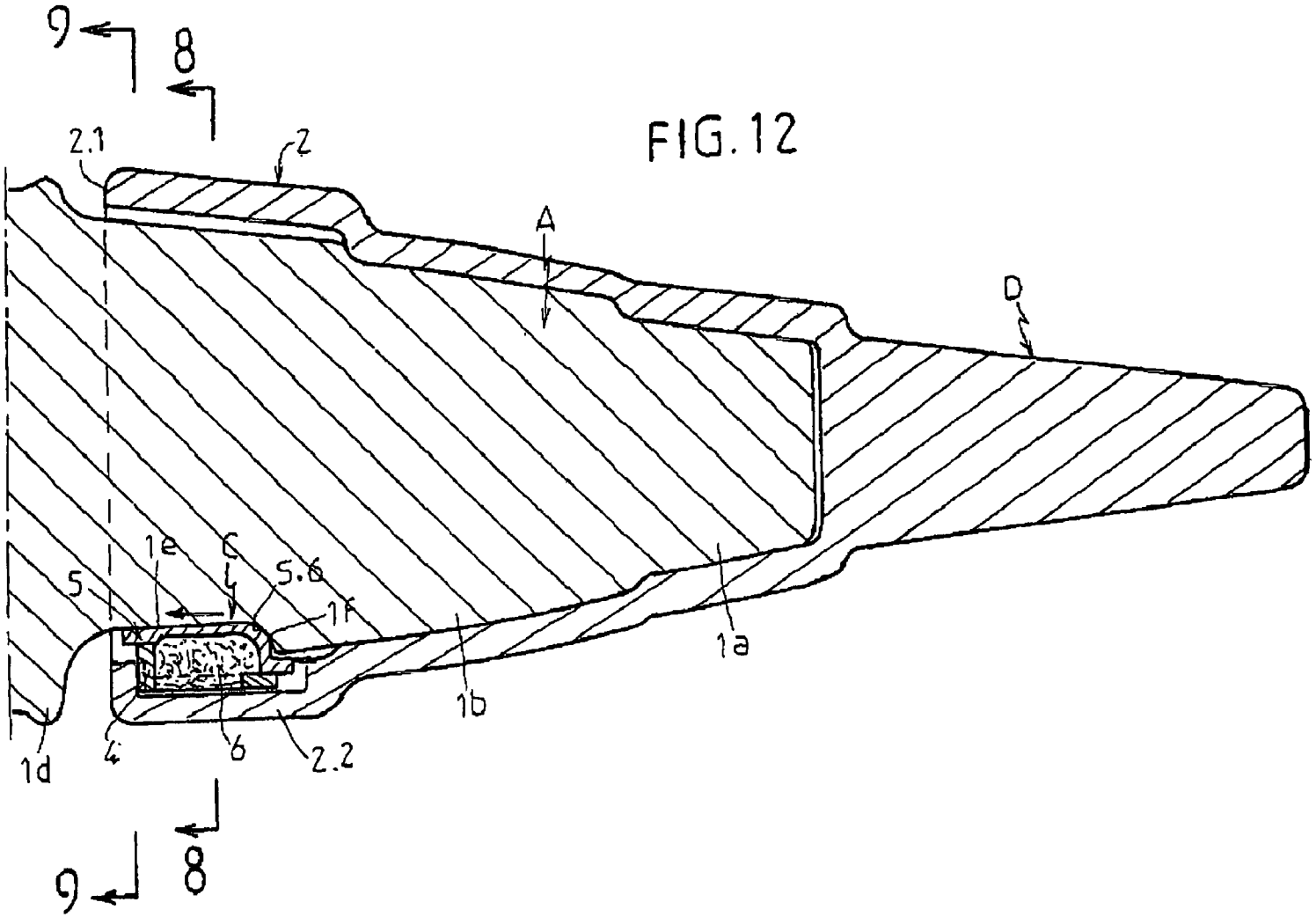
Figure 13:
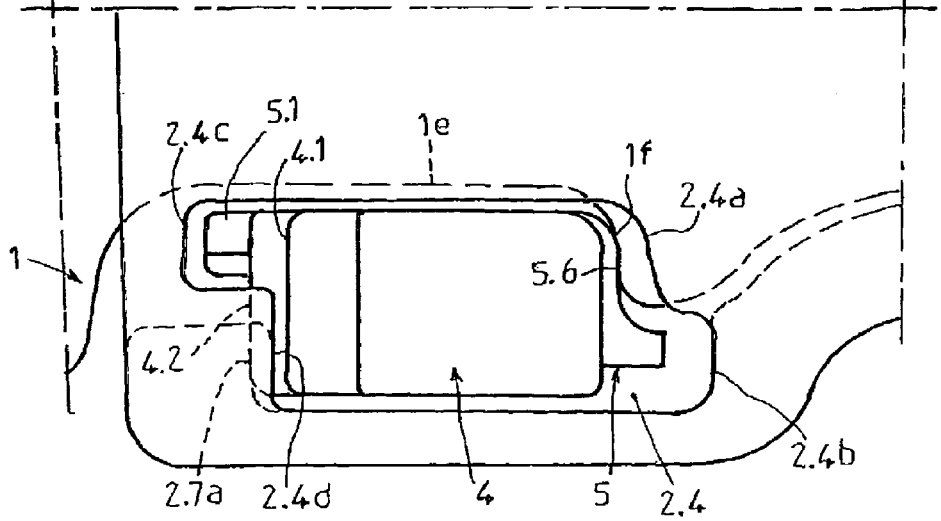
Figure 14:
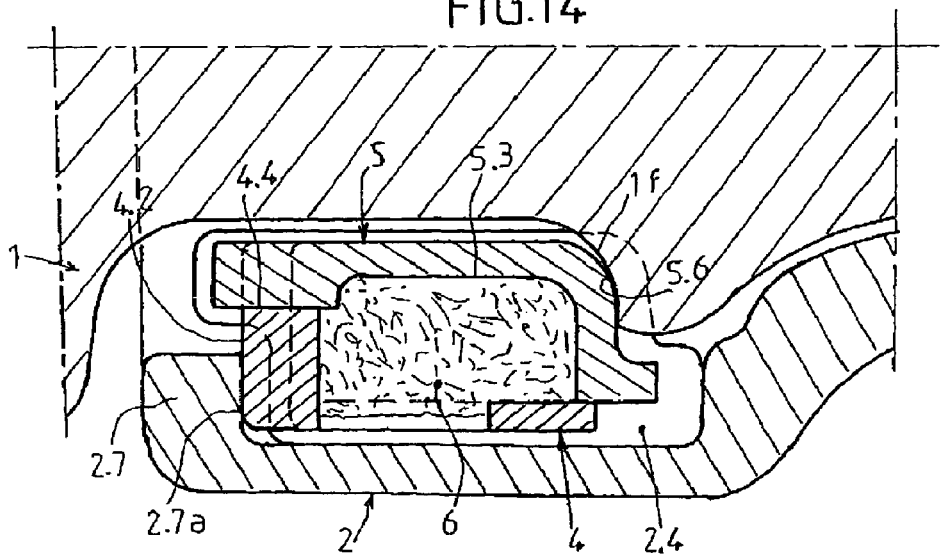
Figure 15:
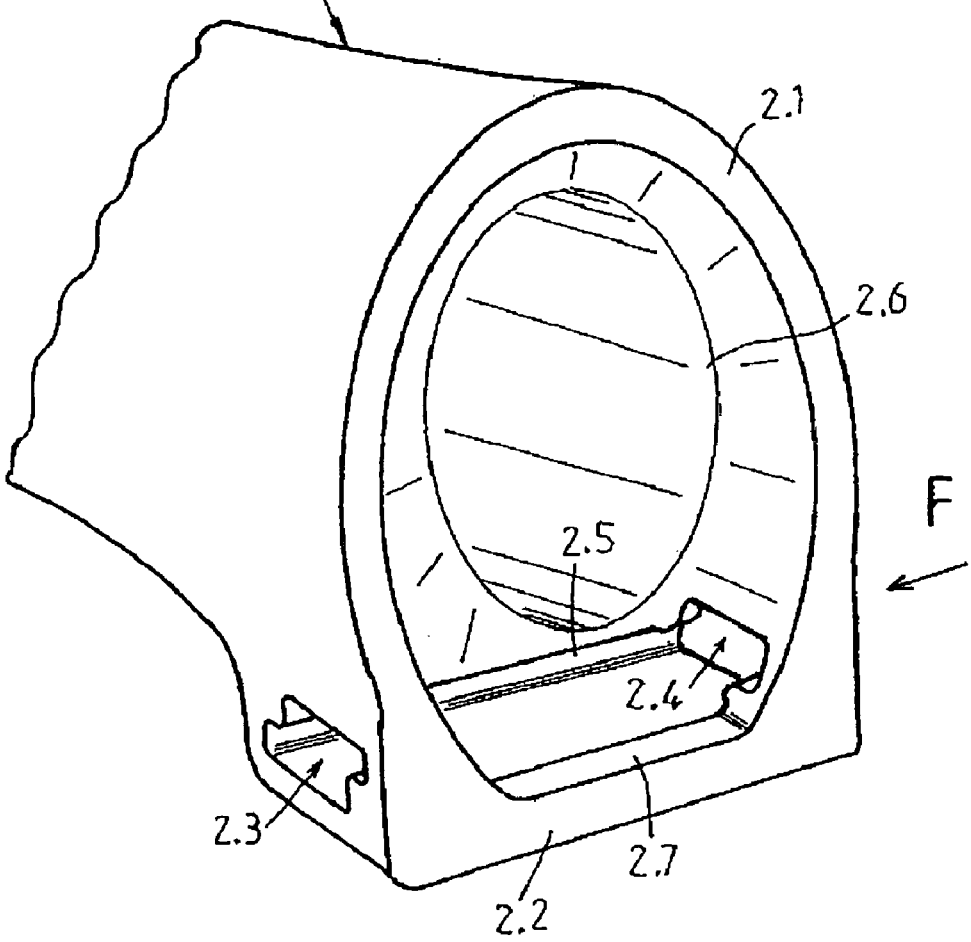
Figure 16:
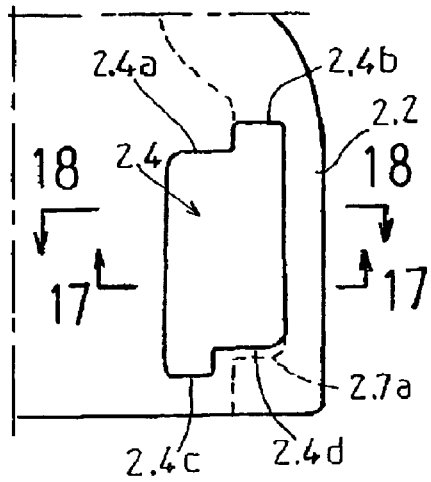
Figure 17:
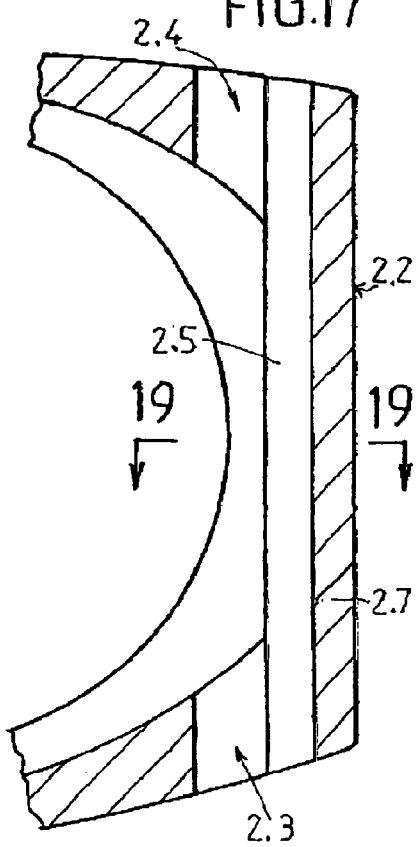
Figure 18:
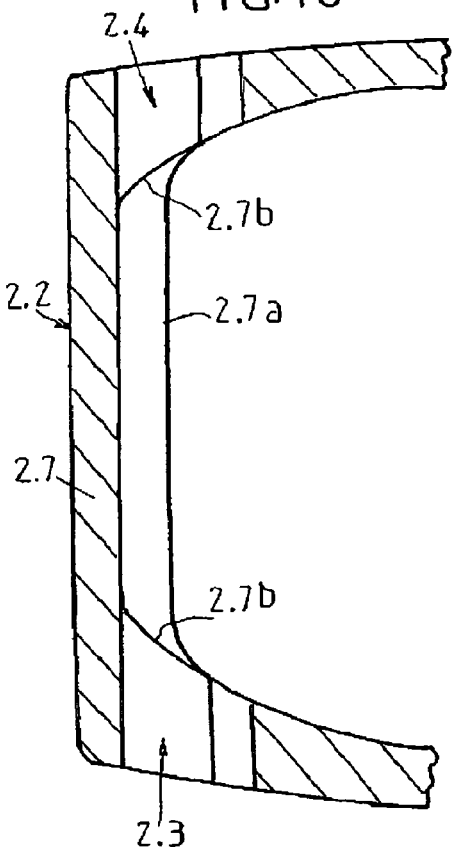
Figure 19:
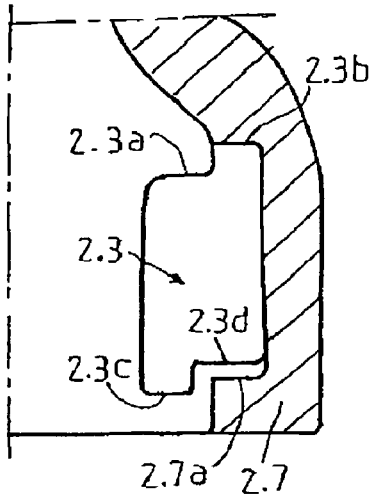

In order to provide a clear idea of the subject of the invention illustrated in nonlimiting manner in the figures of the drawings wherein:

FIG. 1 is a view in perspective of a tooth-adapter nose assembly for a connecting and coupling key, according to the invention, before assembly, FIG. 2 is a rear three-quarter view in perspective illustrating the key in two separate portions before assembly, FIG. 3 is a front view in perspective, according to FIG. 2, of the key, FIG. 4 is a rear view of the assembled key, FIG. 5 is a side view of the assembled key, FIG. 6 is a front view of the assembled key, FIG. 7 is a view of the opposite side to that of the preceding view of the assembled key, FIG. 8 is a sectional view of the tooth and the adapter nose, along the line 8.8 of FIG. 12 illustrating the beginning of insertion of the key, FIG. 9 is a view in section, along the line 9.9 of FIG. 12, illustrating the final position of the key, FIGS. 10*a*, 10*b*, 10*c* are partial, large scale views illustrating the progressive insertion of the key into the tooth-adapter nose assembly, FIG. 11 is a view, according to FIG. 10, illustrating the positioning of the key in order to couple together the tooth and the adapter nose, FIG. 12 is a view in longitudinal section showing the tooth-adapter nose assembly according to the invention, FIG. 13 is a partial external view, in the direction of the arrow F of FIG. 15, FIG. 14 is a partial view in section, along the line 14.14 of FIG. 11, but after positioning of the key in the tooth-adapter nose linkage, showing a new position of the two components of the key relative to one another, followed by the assembly bond, FIG. 15 is a partial view in perspective illustrating the throat of the tooth, FIG. 16 is a partial view in the direction of the arrow F of FIG. 15, FIG. 17 is a view in section of the tooth in the front portion, along the line 17—17 of FIG. 16, FIG. 18 is a view in section of the tooth in the rear portion along the line 18—18 of FIG. 16, FIG. 19 is a view in partial section along the line 19—19 of FIG. 17.

In order to make the subject of the invention more concrete it will now be described in a nonlimiting manner illustrated in the figures of the drawings.

The invention applies to the installation of wear pieces such as teeth and adapter nose, scoops, and any similar wear pieces adapted and used for land or maritime public works machines, various items of equipment for working and processing materials and handling them.

The rest of the description will refer essentially to the application of the invention to teeth and adapter noses.

The invention therefore concerns a device for coupling linkage between the tooth identified in its entirety by (D) and an adapter nose identified in its entirety by (A), the linkage means being a key identified by (C).

In known manner, the adapter nose (A) intended to take the tooth (D) comprises four successive portions, the whole assembly forming a complete solid piece attached in any appropriate manner onto the bucket or other receptacle. The end of the nose, shown in FIG. 1, is cross-hatched to signify that it may be anything depending on the attachment method.

The portion (1*a*) is tapered and reaches the bottom of the tooth, this portion being of any appropriate configuration. It is followed by a portion (1*b*) of greater section in contact with the opposite wall of the tooth. The next portion (1*c*) has, in known manner, and transversely, a cut-out (1*e*) for the key (C) to pass through, defining a transverse border (1*f*) forming an abutment plane. The width of this cut-out is appropriate for the key to pass through. The next or end portion (1*d*) constitutes the return wall of the adapter nose for the purpose of attaching it to the bucket or receptacle. An adapter nose of this type is used by all manufacturers.

According to the invention, the adapter nose (A) is capable of fitting into the tooth (D), which has a specific shape on the one hand in order to allow contact and opposing contact zones to be obtained that are different from and greater than those of the prior art for better distribution of the stress forces and, on the other hand, to allow optimized protection of the adapter nose.

The tooth (D) thus has, according to a first feature, at its rear end away from the scraping point portion, an enveloping shaped skirt (2) which is part of the same casting as the tooth. This skirt is intended to cover the adapter nose as much as possible over the whole of its peripheral contour while reaching substantially beyond the portion (1*c*) of the latter corresponding to the zone through which the key passes. Thus, the skirt has a shaped enveloping configuration (2.1) whose form corresponds to that of the adapter irrespective of the form of the latter; widening to form a throat without however being in contact with the adapter nose in this location, as appears in FIG. 12 of the drawings and with a clearance. The other portion of the skirt forms a rectilinear flat return wall (2.2) with a border forming a ridge (2.7). This rectilinear return wall is established in the whole width of the skirt and corresponds to the passage and the contact positioning of the key (C). Near the ends of said return wall, and in the thickness of the skirt are openings (2.3–2.4) for the key to pass through such that the latter is engaged through one of the openings and is positioned on the inner portion of the return wall. These openings have a square or rectangular form (2.3*a*–2.4*a*) with one or two additional protruding indentations (2.3*b*–2.3*c*–2.4*b*–2.4*c*) situated in opposition and at different levels for the passage of the specially shaped key as will be described hereinafter.

It should be specified that, when the key is inserted or extracted, the openings exhibit an abutment wall (2.3*d*–2.4*d*) whose conditions will be explained hereinafter.

As illustrated in FIG. 15, the return wall (2.2) comprises a first rectilinear front guidance ramp (2.5) projecting slightly from the inner plane of the return wall, said first ramp being next to the inner walls (2.6) of the tooth emerging into the receiving portion and in contact with the adapter nose.

In addition, the return wall (2.2) of the tooth consists, at the end, of said rectilinear bordering ridge (2.7) situated adjacent to the plane of the opening connecting with the outer profile of the skirt and thus providing a complete closed shape of the skirt. This bordering ridge (2.7), via an inner step (2.7*a*), constitutes a rear zone of abutment of the key along the whole length (2.7*a*) of said step. In addition, said bordering ridge is provided on its inner face with a section forming a seat (2.7*b*) for a certain zone forming a stopping and positional latching zone of the key, as will be explained hereinafter. Thus, in FIGS. 15, 16, 17, 18 and 19, one specific such arrangement has been shown. It should be noted that said openings for the key to pass through have no abutment or contact or opposing contact function in an operating situation. However, one of the openings (2.3) forms, by one face (2.3*d*) a zone of abutment and transverse movement limitation of the key exclusively when it is inserted, the other opening (2.4) having an identical abutment face (2.4*d*) for the guidance and removal of the key or vice versa.

The features of the key (C) which is illustrated in all its forms in the figures of the drawings will now be explained.

The key thus comprises two components (4–5) that are transversely adjustable one relative to the other according to the position of the key, being inserted into the tooth-adapter nose pair, then in a coupled situation, and equally in a wear situation.

In addition to the phase of inserting the key in a predetermined direction, said key is capable of a transverse movement in its positioning phase.

In the operating relationship of the two components, one of the components is fixed (4), the other (5) is able to move transversely relative to the preceding one. The two components are mutually guided by specific forms, and are rigidly attached to one another by the insertion of an elastomer material (6) which will be explained hereinafter, each of said components being provided with specific shapes capable of contact and opposing contact on the opposing abutment faces of the tooth and of the adapter nose in order to ensure a firm linkage of the coupling and hence of the tooth-adapter nose relationship.

More specifically, the fixed component (4) is configured as a body of great length defining the length of the key, and having a width capable of being placed against the inner return wall (2.2) in the skirt (2) which passes through the aforementioned openings (2.3–2.4). This body has, on its front face, and along the corresponding vertical side (4.1), a flat strip (4.2) of extra thickness whose ends (4.3) are beveled. Said flat strip (4.2) serves as a face for abutment with the wall (2.3*d*) of the opening (2.3) when the key is inserted. This specific shape (4.2) is intended to center and latch itself as it presses on the shape corresponding to the transverse bordering ridge (2.7) of said return wall, by means of its inner step (2.7*a*) and the seat portion (2.7*b*). In addition, the main body (4) is open in its inner volume and has a transverse cut-out (4.4) with guidance grooves (4.5) to allow the second component (5) to move. Elongate openings (4.6) are also established on the top face of said main body in order to provide a dual function, that is to say to allow the insertion and then the expansion of the elastomer material.

The secondary mobile component (5) has an L-shaped profile and is capable of moving relative to the main body (4). For this purpose, the secondary body has a flat plateau (5.1) whose ends (5.2) are tapered to engage in the guidance grooves (4.5) formed transversely on the main body. The plateau has a blind inner cavity (5.3) capable of receiving the linkage material (6) which holds together the whole of said assembled key. The plateau of the secondary body continues with a right-angled wing (5.4) that has an abutment face (5.6) that is capable of contact against the opposite face of the adapter nose, as will be explained hereinafter. This wing (5.4) may have in turn a rectilinear border (5.5) that will be capable of being positioned above the abutment border of the adapter nose. It should also be noted that the secondary body (5) has, on either side of its contact face and face of abutment against the adapter nose, flats (5.7) forming ramps oriented in the lengthwise direction whose function will be specified with the description and installation of the key, E.

As a variant, the face of the key that contacts the ridge of the tooth may be straight, rectilinear or curvilinear, as shown in dashed lines (FIG. 7). The curvilinear form helps to keep the key in position, the housing being of matching configuration.

The packing material (6) may be an elastomer resin or similar and fills the totality of the space of the inner volume of the main body and of the secondary body, as shown in FIG. 14, without emerging from or being flush with the level of the elongate apertures formed in the main body. The material solidifies such that the key is ready to be assembled. In this situation, the secondary body is positioned on the main body such that the rear side contacting the abutment zone is the same plane as the front face of the main body. Thus, the key is in the state shown in FIG. 5. The packing material is chosen such that it offers properties satisfying various parameters:

- integrity of the key that is rendered a solid piece,
- the tooth-adapter nose linkage holds despite the stresses of use,
- it has properties of compression and extension to satisfy the various situations of installing the key but also, over time, after wear, keeps the tooth and the adapter nose in a position still relative to one another,
- it has hold and shear properties by movements of the two key components relative to one another.

It is now appropriate to carry out and explain the operation of assembling and installing the key.

With reference to FIGS. 10*a*, 10*b* and 11, installation takes place as follows.

According to FIG. 10*a*, the key that forms a complete solid piece with its two components (4–5) and packing material (6) is inserted in the direction of the arrow F1, into the free space formed between the tooth and the adapter nose. In this situation, the key is inserted in the direction of the arrow (f1) until the rear face of the key is opposite the bordering ridge (2.7) of the aforementioned return wall formed on the skirt. The key, by its portion (4.2), then comes into abutment and guidance contact with the wall (2.3*d*) of the opening (2.3). In the phase according to FIG. 10*b*, the key is positioned such that the ramp (5.7) formed on the secondary body is placed against the abutment portion (1*f*) formed on the adapter nose so as to create a phenomenon of compression of the packing material. Phase number 3 (FIG. 10*c*) of inserting the key is partial. It can be seen in particular that the lip (5.6) established on the secondary body (5) at the edge of the L-shaped portion, comes against the abutment portion (1*f*) formed on the adapter nose, while there is still contact between the key and the aforementioned opening wall (2.3*d*). As the key is inserted, its secondary body tends to incline obliquely, as shown in FIG. 10*c*, causing an additional effect of compressing the packing material. In the next phase, shown in FIG. 11, the key is completely inserted and it has escaped the wall (2.3*d*) of the opening (2.3). In this situation, the key, by its main body, is substantially advanced while being correctly positioned since the protruding portion (4.2) formed on the main body (4) is positioned centrally in contact with the corresponding seat portion (2.7*b*) and step portion (2.7*a*) established on the bordering ridge (2.7) of the return wall, in a latching situation. Furthermore, it is in this position that the compressed packing material which distends elastically, fills the zone of the initial unfilled elongate openings formed on the key and may slightly protrude, as shown in FIG. 14.

The components of the key, as shown in FIG. 11, tend to separate transversely one from the other by a few millimeters while abutting in the aforementioned conditions. It should be noted that the separation of the two components is of the order of approximately 5 millimeters corresponding to the distance (d) shown in FIG. 7.

There is therefore an effect of compression of the material and the assembly is held securely. The key is then held between the tooth and the adapter nose, firmly and correctly, on the one hand in the abutment zone (1*f*) opposite the adapter nose portion and the rear abutment zone opposite the bordering ridge (2.7) formed on the return wall of the skirt. These abutment zones are of very great length, compared with the prior art. The assembly is therefore securely held.

It should be remembered that the opening zones (2.3–2.4) have no abutment function in an operating situation after installation of the key.

The key is removed by a striking operation which causes the material to compress, the key to unlatch from the receiving seat and shape (2.7*a*–2.7*b*) and hence causes the key to be released.

In this configuration of the invention, the proposed device makes it possible to satisfy the various objectives sought as specified hereinabove.

The opening (2.4) has, in its turn, a guidance face (2.4*d*) identical to that (2.3*d*) which is used to make contact with the key for its release.

Furthermore, the complete skirt offers virtually total protection of the adapter nose and of the key system and consolidates the tooth retention zone and creates a screen against the ingress of material that may compromise the key system or the removal of the tooth and may compromise the contact zones established between the tooth and its adapter support.

In the context of an extension of the invention, it is conceivable that the tooth be adapted for the passage of two opposite keys. In this case, the adapter is given two opposite cut-outs (1*e*).

The invention claimed is:

1. A device for coupling linkage between wear pieces at ends of receptacle tools in use on machines, comprising a tooth fitting onto an adapter nose and coupled by a key, the adapter nose having a zone with a transverse vertical or horizontal cut-out for the key to pass through and defining a transverse border forming an abutment surface, wherein the tooth has, at its rear end away from a scraping point, an enveloping skirt covering the adapter nose beyond the zone through which the key passes, said skirt having a shaped configuration connecting to a rectilinear flat return wall, comprising a bordering ridge, and wherein said return wall is established in a width of the skirt and corresponding to passage and positioning of the key, and wherein located adjacent ends of said return wall, and in a thickness of the skirt, are openings for the key to pass through with no abutment function in an operating situation and performing a guidance and abutment function exclusively when the key is inserted or removed, and wherein the key comprises two components movable one relative to the other, in a transverse direction, said key having, on each of these components, contact and opposing contact abutment zones, on the one hand, abutting against the abutment surface of the adapter nose and, on the other hand, against the return wall, at the place of its bordering ridge, in a space situated between the openings for the key to pass through.

2. The device as claimed in claim 1, wherein the skirt has a shaped enveloping configuration widening to form a throat without being in contact with the adapter nose, an other portion of the skirt forming the return wall, and the openings through which the key passes have matching protruding openings for the key to pass through.

3. The device as claimed in claim 2, wherein the openings have an abutment and guidance face when the key is inserted and extracted, and wherein the openings have no abutment and guidance function after the key is inserted.

4. The device as claimed in claim 1, wherein the return wall comprises a first rectilinear guide ramp situated as a protrusion relative to an inner plane of the return wall and next to inner walls of the tooth, and the bordering ridge being rectilinear and adjacent to a plane of an opening connecting with an outer shape of the skirt and providing a complete closed shape of the skirt, said bordering ridge forming an abutment zone for the key across its whole width.

5. The device as claimed in claim 4, wherein the bordering ridge forms an inner step in a location of indentations formed on the openings for the key to pass through, and on either side a section forming a seat for a certain zone of the key and forming a zone of stopping and of positional latching of the key.

6. The device as claimed in claim 1, wherein said components receive a packing material that links the two components and holds the whole of said key firmly together and allows, by relaxation, each of said components to butt up against the abutment surface of the adapter nose and the bordering ridge of the tooth.

7. The device as claimed in claim 6, wherein a fixed component of said components is made as a body of specified length defining a length of the key and being capable of fitting against the inner return wall in the skirt, said body having, on a front face and along a vertical side, a flat strip of extra thickness whose ends are beveled, to form a shape intended to press against and latch onto a shape corresponding to the bordering ridge of the return wall.

8. The device as claimed in claim 7, wherein a main body of the fixed component is open in its inner volume and has a transverse cut-out with guidance grooves to allow a second component of said components to move, and wherein elongate openings are established on a top face of said body.

9. The device as claimed in claim 8, wherein the second component has an L shape with a flat plateau whose ends are tapered to engage in the guidance grooves on the main body, said plateau having a blind inner cavity receiving the packing material, said plateau having a right-angled wing with an abutment face in contact with the abutment surface of the adapter nose, and wherein said second component has, on either side of its abutment face, flats forming ramps oriented lengthwise.

10. The device as claimed in claim 6, wherein the packing material comprises an elastomer resin.

* * * * *